United States Patent [19]

Poloni

[11] Patent Number: 4,744,234

[45] Date of Patent: May 17, 1988

[54] SUPERCOMPACT ROLLING GROUP WITH ROLLS SUPPORTED AT ONE END, AND A ROLLING LINE COMPRISING GROUPS THUS FORMED

[75] Inventor: Alfredo Poloni, Ronchi dei Legionari, Italy

[73] Assignee: Danieli & C. Officine Meccaniche SpA, Buttrio, Italy

[21] Appl. No.: 834,106

[22] Filed: Feb. 24, 1986

Related U.S. Application Data

[63] Continuation of Ser. No. 583,220, Feb. 24, 1984, abandoned.

[30] Foreign Application Priority Data

Feb. 25, 1983 [IT] Italy ..... 83336 A/83

[51] Int. Cl.[4] ..... B21B 35/04; B21B 1/00; B21B 31/08

[52] U.S. Cl. ..... 72/235; 72/203; 72/205; 72/238; 72/249

[58] Field of Search ..... 72/235, 203, 205, 234, 72/249, 238, 239

[56] References Cited

U.S. PATENT DOCUMENTS

| | | | |
|---|---|---|---|
| 1,858,788 | 5/1932 | Rohn | 72/235 X |
| 3,538,726 | 11/1970 | Cook | 72/203 X |
| 4,187,707 | 2/1980 | Quehen | 72/205 X |
| 4,366,694 | 1/1983 | Pariseau et al. | 72/235 |
| 4,392,370 | 7/1983 | Strandell | 72/235 X |

FOREIGN PATENT DOCUMENTS 634752 8/1934 Fed. Rep. of Germany .

OTHER PUBLICATIONS

"Morgan introduces 85% smaller compact mill", *Iron and Steel Engineer,* Mar. 1982, pp. 60–61.

*Primary Examiner*—Robert L. Sprull
*Assistant Examiner*—Steve Katz
*Attorney, Agent, or Firm*—Wegner & Bretschneider

[57] ABSTRACT

A supercompact rolling group (10) with rolls supported at one end. Vertical (11) and horizontal (12) units are arranged alternately or as necessary. Each unit (11–12) is driven by an independent motor (25–23) through a transmission (34) on parallel axes. A rolling line has at least one supercompact rolling group (110–210) constituted as above.

9 Claims, 3 Drawing Sheets

SUPERCOMPACT ROLLING GROUP WITH ROLLS SUPPORTED AT ONE END, AND A ROLLING LINE COMPRISING GROUPS THUS FORMED

This application is a continuation of U.S. application Ser. No. 583,220, filed Feb. 24, 1984 abandoned.

BACKGROUND OF THE INVENTION

This invention concerns a supercompact rolling group. To be more exact, the invention concerns a rolling group with rolls supported at one end which has a conformation and mutual arrangement of the horizontal and vertical rolling units such as to make possible a considerable reduction of the overall sizes of the whole rolling group and also a better functional nature of the group as compared to known lay-outs.

The invention also concerns a rolling line which comprises one or more groups formed in this manner.

Conventional rolling lines are known which consist of several groups arranged in series so as to obtain a continuous rolling process.

Such groups in their turn can include one or more rolling units, which should be understood as being an assemblage formed substantially by a carrying casing, or portion of a casing, which holds a set of rolls with related means providing support and direct movement.

These rolling lines require considerable space for installation, especially owing to their great lengthwise extent. They therefore require a great deal of covered space consisting of the relative sheds.

This leads to drawbacks linked to the need to have vast areas on which buildings can be erected and also to have accessory plants which cover a considerable extent of ground and are therefore very burdensome and hard to control.

Moreover, the maintenance of conventional plants is also complicated by the considerable extent of the plants themselves.

Furthermore, it is often impossible in such plants to check all the units by eye at the same time.

Embodiments already exist which are intended to lessen the overall size of rolling lines by providing compact groups that combine in themselves several rolling units, both horizontal and vertical.

For instance, patent FR No. 1.456.709 is known and discloses a rolling mill which comprises several units with rolls supported at one end, the units being arranged on a common frame and inclined at 45° with alternate orientations.

This cited patent is mainly intended to enable the rolls to be adjusted and driven in an improved manner and also to facilitate withdrawal of the rolls for maintenance.

Transmission of motion is obtained with two parallel shafts driven by one and the same motor, one of these shafts serving all the units which have an orientation perpendicular to such transmission.

Thus, in this patent the same number of bevel gear pairs is required as the number of rolling units so as to enable the motion of the parallel shafts to be taken by the units.

Patent FR No. 1.465.519 is also known and discloses a substantially analogous solution, the rolls of the units being inclined at 45°, the units themselves being arranged alternately, and the motion being transmitted to parallel shafts that drive the two groups of units, as in the patent cited previously.

Application Ser. No. 2.294.770 for a patent in France in the name of Pomini Farrel describes a cogging mill with alternate vertical and horizontal units. Transmission of motion to the various units is obtained by means of a long shaft stretching along the whole length of the rolling group and serving units that have to receive its motion.

Patent DE-OS-2.243.749 discloses an embodiment like that of the patent cited above.

As we have seen, all the foregoing embodiments make use of long transmission shafts with bevel gear pairs for the offtake of motion for the individual units served by such shafts.

In this way there is a bevel gear pair for each unit belonging to a group, however such unit may be oriented. This entails many drawbacks, among which are the following:

- a great number of bevel gear pairs (one per unit),
- the bevel gear pairs are hard and burdensome to make,
- assembly has of necessity to be very accurate,
- bevel gear pairs are delicate and need precise maintenance and controls, and
- bevel gear pairs make a great deal of noise while working.

SUMMARY OF THE INVENTION

The present invention intends to avoid the foregoing drawbacks and still others and to provide a drive system which enables the bevel gear pairs and parallel shafts to be eliminated. According to the invention this intention is obtained by providing an independent motor for each unit, all the units being combined in one single compact group.

It is also a purpose of the invention to simplify construction of the rolling groups and to facilitate their maintenance.

Another purpose of the invention is to provide a rolling group which includes auxiliary devices to carry out operations that have hitherto been performed by separate devices, which, as they are separate, are subject to many shortcomings and problems of coordination, linking and control or maintenance.

These purposes and yet others which will become clear in the description and drawings hereafter are fulfilled according to the invention by a special coordinated arrangement of the vertical and horizontal units of the group and of the relative motors and reduction gears.

The supercompact lay-out of the units in the rolling group of the invention is made possible by assigning to the individual units forming the group a suitable conformation which enables not only the overall sizes to be reduced but also the desired cooperation to be maintained.

By "vertical" and "horizontal" units we mean units of which the rolls are disposed with their axes substantially vertical and horizontal respectively.

Hereinafter these names will be understood more broadly as indicating units with their axes oriented as may be but substantially perpendicular to each other, this being an orientation which remains within the spirit of the invention.

According to the invention it is possible to envisage the employment of epicyclic reduction gears, which have a minimum overall size and thus make a further contribution to the noteworthy compactness of the rolling group.

According to the invention any suitable alternation of horizontal and vertical units can be arranged. For instance, the units can be positioned alternately vertically and horizontally, or there can be several consecutive units oriented in the same way as each other.

According to the invention each motor is positioned with its axis substantially parallel to the axis of the unit which it drives. In this way a train of cylindrical gears can be employed for each unit since there is no necessity to transmit motion on axes which are not parallel. The bevel gear pairs used in the known cited embodiments are therefore eliminated.

The provision of independent motors also makes it possible to simplify maintenance and also to make better use of the space available, as it is no longer necessary to employ one single motor of a great size.

Moreover, the problems relating to the use of long transmission shafts, such as the problems involved in the support of such shafts and problems of torsion, vibrations, etc. are obviated.

Moreover, the invention covers the possibility of assembling within the group auxiliary means such as shears, loopforming means, etc.

Within a rolling line that includes the group, these auxiliary means make it possible to obtain, owing to the invention, a coordinated relationship and control and a maintenance which would otherwise be impossible.

The outcome is a better use of the space available, better coordination of functions and lower maintenance costs.

According to the invention the units in a group which have rolls of the same diameter comprise roll-bearing headstocks that can be interchanged with each other and be withdrawn speedily for replacement and/or maintenance.

Moreover, several groups constituted according to the invention and having various functions, such as a cogging group, intermediate group and finishing group, for instance, can be combined to form a very compact and well coordinated rolling line.

The invention also envisages the possibility of the modular construction of the rolling group.

To be more exact, it is possible to standardize the construction of the individual units so as to be able to construct, by mere assembly, groups having a number of units which can be varied to suit requirements.

The smaller distance which can be obtained with the invention between consecutive pairs of rolls makes it unnecessary to provide intermediate guides for the rolled sections in most cases. This fact enables further constructional simplification to be obtained and also simplifies access to the individual units and their maintenance.

Such intermediate guides, however, can be envisaged when rolled sections are being processed which could be bent during their passage from one unit to the next one.

The invention is therefore embodied with a supercompact rolling group with rolls supported at one end, which comprises vertical and horizontal units arranged alternately or as necessary, and in which each unit is driven by an independent motor through a transmission on parallel axes. The invention is also embodied with a rolling line which comprises at least one supercompact rolling group constituted in such a way.

BRIEF DESCRIPTION OF THE DRAWINGS

We shall now describe a preferred embodiment of the invention as a non-restrictive example with the help of the attached figures, wherein.

DETAILED DESCRIPTION OF THE PREFERRED EMBODIMENTS

Figure 1A:
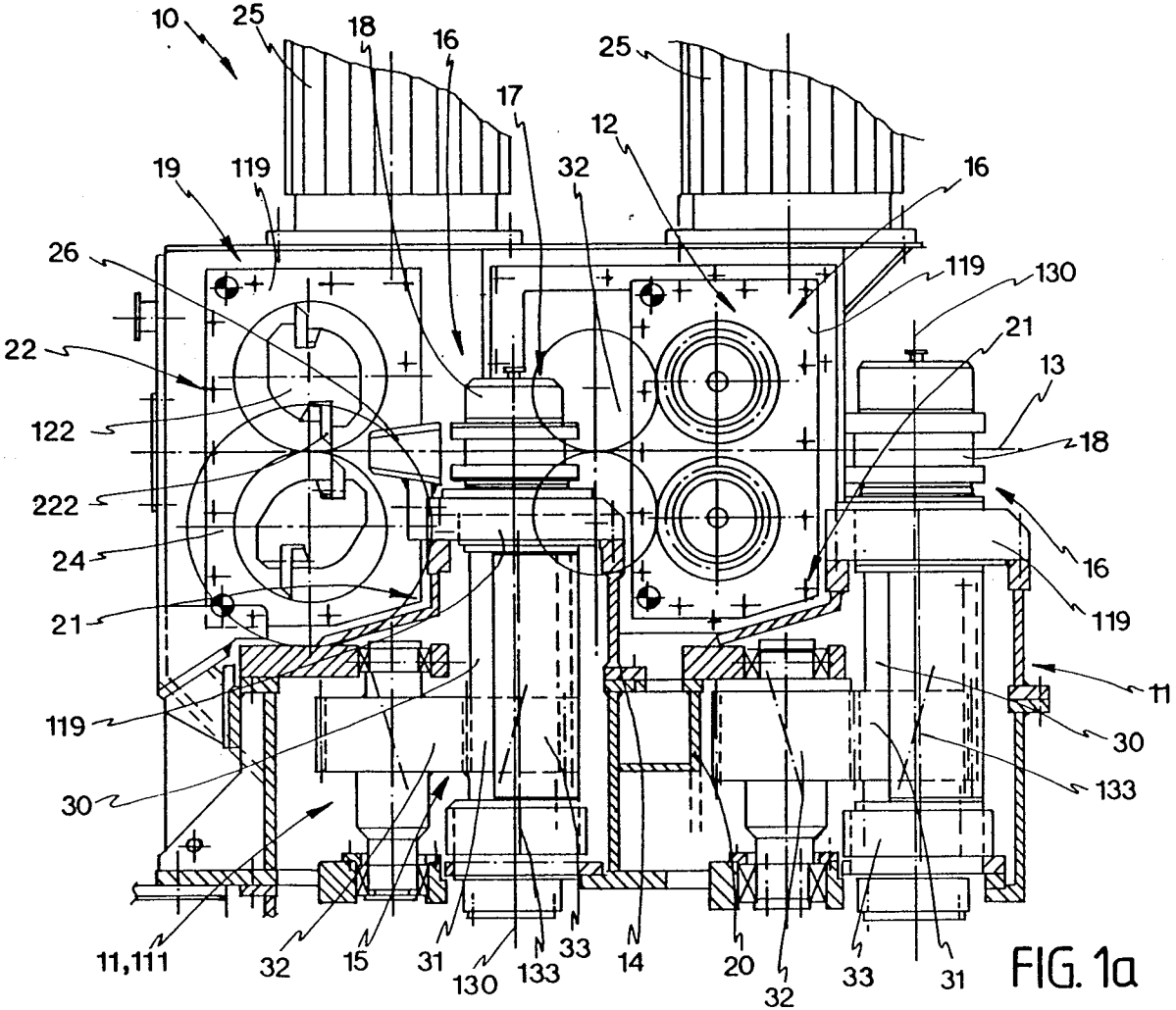
FIGS. 1*a* and 1*b* show two preferably cutaway views of a rolling group according to the invention from the front and side respectively.
Figure 1B:
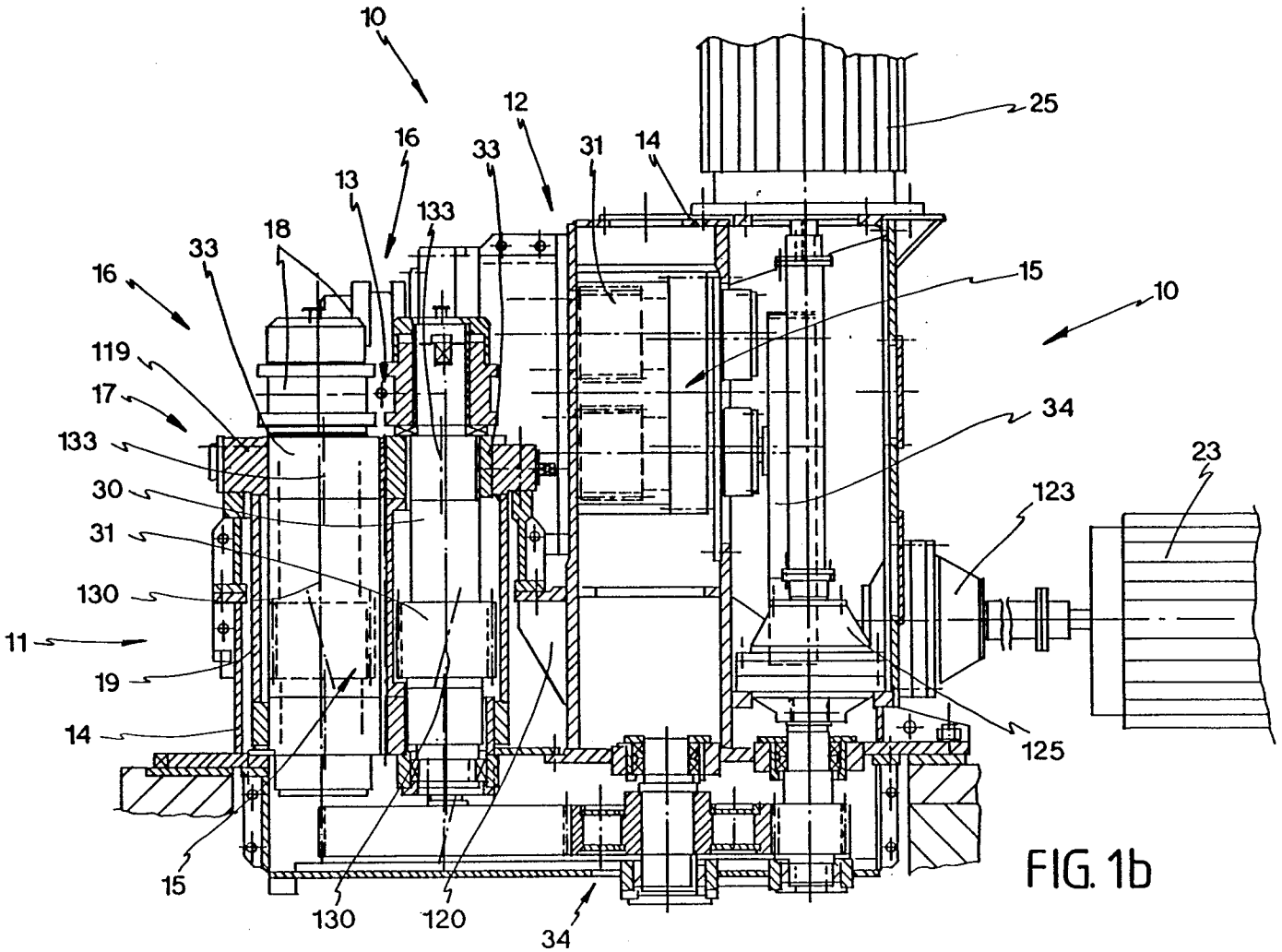

In FIGS. 1*a* and 1*b* supercompact rolling group 10 has in the examples shown two vertical units 11 and one horizontal unit 12.

The group 10 of the invention could, however, include any required number of units however they may be oriented.

In the example shown a rolled section slides from right to left and the rolling axis is indicated with 13.

As the structure of the various units 11–12 of the group 10 is substantially the same in the example shown, we shall describe in detail the unit 111 farthest downstream.

The various parts which form the unit 111 are, in fact, also to be found in the other units with a like function and relative collocation.

A casing 14 having a box-like, substantially L-shaped form encloses a transmission group 15.

The casing 14 can also be included as an independent element on its own or else be envisaged as being integrally joined to the casings of the other units so as to form one single framework for the group 10.

In the example shown the transmission group 15 comprises a shaft 30 for each roll 18. Each shaft 30 has on itself a toothed wheel or pinion 31 which meshes with a pinion 32.

The pinions 32 mesh with each other, only one of the pinions 32 receiving motion from a motor 25 through a train of gears 34.

The motion is transmitted by the pinion 32 thus driven to the other pinion 32, the direction of rotation being inverted.

The contrarotating pinions 32 transmit the motion to the respective pinions 31 and thence through the shafts 30 to the rolls 18, which therefore rotate in the opposite direction to each other.

The pinions 31 do not mesh with each other and therefore the distance between the centres of the rolls 18 can be regulated, a thing which otherwise would be impossible.

An adjustment bush 33 which supports both ends of the shaft 30 is envisaged for each shaft 30 so as to perform the adjustment.

The shaft 30 is fitted off-centre in relation to the adjustment bush 33, so that a rotation of the adjustment bush 33, of which the axis 133 is stationary, causes a displacement of the axis 130 of the relative shaft 30.

The shafts 30 with the adjustment bushes 33, the rolls 18 and a carrying element 19 (see FIG. 1*b*) constitute a headstock 17 bearing rolls.

In the example shown the carrying element 19 comprises an upper plate 119 secured to the casing 14 with screws or other equivalent means. If the screws are removed, the roll-bearing headstock 17 can be withdrawn in one piece very easily.

The headstocks 17 with rolls 18 of the same diameter can be interchanged advantageously, and a speedy replacement is made possible in this way for adjustment and/or maintenance purposes.

Moreover, standardization of the parts forming the headstocks 17 themselves simplifies construction of the whole assemblage.

The casings 14 of neighbouring vertical units 11 are connected with a union means 20, which can be envisaged as being an element on its own or as forming one block with the casing 14 of one of the neighbouring units 11.

A like union is visualized between neighbouring horizontal units 12.

The horizontal 12 and vertical 11 units in their turn comprise suitable means 120 for reciprocal union, such as flanged or angled elements or elements of another kind.

Where the casings of the various units form one single structure, the union means are an integral part of that structure.

The special L-shaped conformation of the units 11–12 has the effect that in correspondence with a substantially concave portion 21 delimited by the casing 14 and by the rolls 18 (on their left in FIG. 1*a*) there can be positoned an elongated portion 16 of a neighbouring unit 12–11 having a different orientation.

FIG. 1*a* also shows a possible positioning of shears 22, here flying shears, in correspondence with the concave portion 21. In the example shown the flying shears 22 have two rotors 122 with blades 222.

The flying shears 22 can be withdrawn advantageously, being fitted to a carrying element 19 like the carrying elements 19 of the headstocks 17.

The special arrangement of the shears 22 thus incorporated in the group 10 obviates the necessity of providing shears separately with a resultant increase in the overall size.

The shears 22 can get their motion from a motor 23 that activates a unit, a horizontal unit 12 in our example, with its axis parallel to the axes of the rotors 122, by means of a train of cylindrical gears; or else an independent motor 24 can be envisaged for driving the shears 22 separately.

Each vertical unit 11 gets its motion from a motor 25 having a vertical axis.

The kinematic mechanisms 34 for transmission of motion from the motors 23–25 to the transmission groups 15 of the individual units are of a known type with cylindrical gear wheels.

This transmission can have advantageously epicyclic reduction gears 123 and 125 for each motor 23–25 respectively.

The employment of epicyclic reduction gears makes possible a considerable saving of space.

As can be seen in FIGS. 1*a* and 1*b*, the lay-out of the units 11–12, which is made possible by their special L-shaped conformation, enables the distance between centres of rolls 18 of neighbouring units to be about the same as, or even less than, twice the diameter of the rolls 18 themselves, the distance in question being that between two consecutive units having orientations different from each other, namely between a horizontal unit and a vertical unit.

The distance between centres will obviously be greater, about double, in the case of consecutive units having the same orientation as each other, but even so the reduced overall bulk of the individual units in the direction of rolling will remain very modest.

A guide, or inlet, may perhaps be employed between two consecutive units having the same orientation so as to guide the rolled sections and prevent them from being bent, depending on the type of rolled section being processed.

FIG. 1*a* shows a guide 26 located upstream from the flying shears 22, the guide 26 being required in that position to prevent dangerous deflections of the rolled sections during shearing.

Figure 2:
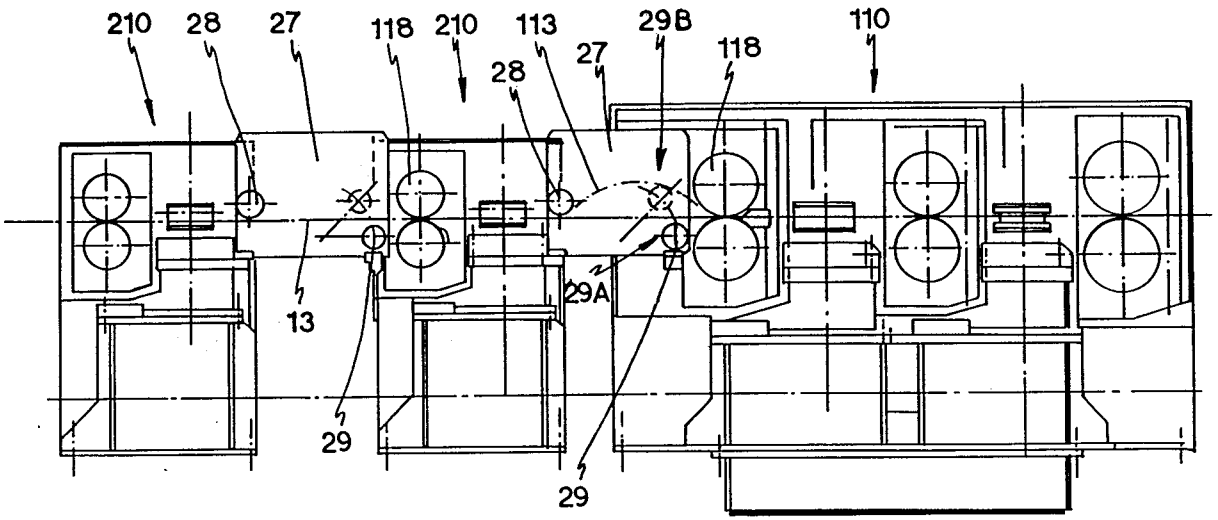
FIG. 2 gives a front view of a rolling line formed with groups and accessory means according to the invention.

FIG. 2 shows part of a rolling line having groups according to the invention.

From right to left along the path of the rolled sections can be seen a cogging group 110 and two finishing groups 210.

Loop-forming means 27 are located between successive groups 110–210. The function of the loop-forming means 27, as is known, is to prevent the creation of a pulling action on the rolled section, for such an action could have an unfavourable effect on the rolling process.

In the example shown the loop-forming means 27 are connected directly to the neighbouring groups 110–210. This obviates the need to provide appropriate supporting means.

The loop-forming means 27 according to the invention offer constructional simplification as compared to known solutions.

Known loop-forming means consist generally of two fixed idler rolls and one roll substantially able to move crosswise to the direction of rolling.

According to the invention the function of one of the fixed rolls is carried out by the rolling roll 118 immediately upstream from the loop-forming means 27.

A fixed idler roll 28 is located at the outlet end of the loop-forming means 27.

A movable roll 29 can move substantially crosswise to the rolling axis 13 between positions 29A and 29B. In the latter position 29B the roll 29 displaces the rolled section to form a loop 113.

In a rolling line consisting of groups according to the invention, shears 22 can be incorporated in one or more groups as in FIG. 1*a*, and a variable number of loop-forming means 27 can be comprised, to suit the specific requirements.

We have described here a preferred embodiment of the invention but many variants are possible without departing thereby from the scope of the invention itself.

For instance, the number and sequence of the units 11–12 belonging to one group can be varied.

It is also possible to constitute a rolling line with several groups according to the invention as required, or else with groups according to the invention in conjunction with conventional groups.

The shapes and proportions of the individual parts can be varied and different types of rolls 18 can be employed. Transmission means other than those shown 34-123-125 can also be visualized. It is also possible to envisage one single motor as being able to drive several units oriented in the same way.

Further variants are possible for a person skilled in this field without departing thereby from the scope of the idea of the solution proposed.

INDEX

10—supercompact rolling group
110—cogging group

210—finishing group
11—vertical units
111—vertical unit
12—horizontal units
13—rolling axis
113—loop
14—casing
15—transmission group
16—upper part or elongated portion
17—roll-bearing headstock
18—rolls
118—roll upstream from the loop-forming means
19—carrying element
119—upper plate
20—union means
120—union means
21—concave portion
22—shears
122—rotors
222—blades
23—motor
123—epicyclic reduction gear
24—motor
25—motor
125—epicyclic reduction gear
26—guide
27—loop-forming means
28—fixed idler roll
29—movable roll
29A—position of rest
29B—working position 30—shaft
130—axis of shaft
31—pinion
32—pinion
33—adjustment bush
133—axis of adjustment bush
34—cylindrical gear transmission.

I claim:

1. A supercompact rolling group having rolls that are supported at one end only, comprising:

vertical and horizontal roll units, each roll of each said roll unit supported at one end only, each of said roll units having a substantially L-shaped casing, each of said casings in each pair of adjacent casings being arranged so that the longer leg of one of said casings fits within the space between the two legs of the other casing to form a compact arrangement;

a frame;

a number of independent motors equal in number to the number of said vertical and horizontal roll units, said motors solidly fixed to said frame;

a gear train coupled to each of said motors; and a number of transmission groups, each transmission group contained within a corresponding casing, each of said transmission groups coupled between one of said gear trains and said corresponding roll unit, so that said transmission groups receive motion from said motor for actuation of its respective roll unit, wherein each transmission group, its respective motor and gear train, and the rolls of the respective roll unit have parallel, but offset, axes of rotation and lie on parallel planes.

2. The supercompact rolling group of claim 1, wherein the distance between the centers of rolls of neighboring units having a different orientation is less than or equal to twice the diameter of said rolls.

3. The supercompact rolling group of claim 1 further comprising epicyclic reduction gears for transmitting motion from said independent motor to said roll units.

4. The supercompact rolling group of claim 1, having at least roll-bearing headstocks having interchangeable rolls of the same diameter.

5. The supercompact rolling group of claim 1 further comprising shears supported by said frame, said shears having rotating blades, the distance between the axes of said rotating blades and the axes of the rolls of a neighboring roll unit being less than or equal to twice the diameter of said rolls.

6. The supercompact rolling group of claim 5, further comprising a separate motor for activating said shears.

7. The supercompact rolling group of claim 5, wherein the motor for activating said shears is a motor that drives at least one of said units.

8. A rolling line comprising:

a loop-forming means including a movable roll and a fixed idler roll immediately upstream from said movable roll; and at least one supercompact rolling group having rolls that are supported at one end only, said rolling group comprising:

vertical and horizontal roll units, each roll of each said roll unit supported at one end only, each of said roll units having a substantially L-shaped casing, each of said casings in each pair of adjacent casings being arranged so that the longer leg of one of said casings fits within the space between the two legs of the other casing to form a compact arrangement;

a frame;

a number of independent motors equal in number to the number of said vertical and horizontal roll units, said motors solidly fixed to said frame;

a gear train coupled to each of said motors; and a number of transmission groups, each transmission group contained within a corresponding casing, each of said transmission groups coupled between one of said gear trains and said corresponding roll unit, so that said transmission groups receive motion from said motor for actuation of its respective roll unit, wherein each transmission group, its respective motor and gear train, and the rolls of the respective roll unit have parallel, but offset, axes of rotation and lie on parallel planes.

9. The rolling line of claim 8 further comprising at least one loop-forming means in which said fixed roll immediately upstream from a movable roll is a rolling roll.

* * * * *